US007275283B2

(12) United States Patent
Kistner et al.

(10) Patent No.: US 7,275,283 B2
(45) Date of Patent: Oct. 2, 2007

(54) APPLIANCE HINGE

(75) Inventors: Adam Kistner, South Williamsport, PA (US); James Alexander Witter, Montoursville, PA (US)

(73) Assignee: Keystone Friction Hinge Co., South Williamsport, PA (US)

( * ) Notice: Subject to any disclaimer, the term of this patent is extended or adjusted under 35 U.S.C. 154(b) by 54 days.

(21) Appl. No.: 11/120,663

(22) Filed: May 3, 2005

(65) Prior Publication Data

US 2006/0032019 A1 Feb. 16, 2006

Related U.S. Application Data

(60) Provisional application No. 60/567,768, filed on May 3, 2004.

(51) Int. Cl.
*E05F 1/08* (2006.01)
*E05D 7/12* (2006.01)

(52) U.S. Cl. ..... 16/286; 16/258

(58) Field of Classification Search ..... 16/286–288, 16/343, 362, 261, 258, 260, 382; 49/386, 49/387, 388, 389; 126/194, 192, 190
See application file for complete search history.

(56) References Cited

U.S. PATENT DOCUMENTS

| | | | | |
|---|---|---|---|---|
| 3,015,125 | A | 1/1962 | Curtis | |
| 3,040,732 | A | 6/1962 | Doner | |
| 3,072,117 | A | 1/1963 | Stoligrosz et al. | |
| 3,677,259 | A | 7/1972 | Doner | |
| 3,712,287 | A * | 1/1973 | Summers, Jr. | 126/191 |
| 3,749,080 | A * | 7/1973 | Kleinhenn | 126/191 |
| 4,315,495 | A * | 2/1982 | Jellies | 126/194 |
| 5,937,481 | A * | 8/1999 | Faringosi | 16/332 |
| 6,035,848 | A | 3/2000 | Ray et al. | |
| 6,397,836 | B1 * | 6/2002 | Pelletier et al. | 126/194 |
| 6,453,510 | B1 * | 9/2002 | Cummins et al. | 16/343 |
| 6,539,581 | B1 * | 4/2003 | Faringosi | 16/327 |
| 6,637,319 | B1 * | 10/2003 | Vanini et al. | 99/467 |
| 6,892,424 | B1 * | 5/2005 | Habegger et al. | 16/289 |
| 2003/0056328 | A1 * | 3/2003 | Habegger et al. | 16/343 |
| 2003/0213098 | A1 * | 11/2003 | Cummins et al. | 16/286 |
| 2004/0172787 | A1 * | 9/2004 | Collene et al. | 16/289 |

FOREIGN PATENT DOCUMENTS

| | | | |
|---|---|---|---|
| DE | 4105274 | A * | 11/1991 |
| DE | 4040965 | A1 * | 6/1992 |
| DE | 4108816 | A1 * | 9/1992 |
| DE | 19824148 | A1 * | 12/1998 |
| DE | 10152907 | A1 * | 9/2002 |
| EP | 1039231 | A2 * | 9/2000 |
| EP | 1619442 | A1 * | 1/2006 |
| GB | 2235723 | A * | 3/1991 |

* cited by examiner

*Primary Examiner*—Chuck Y. Mah
(74) *Attorney, Agent, or Firm*—Reed Smith LLP

(57) ABSTRACT

The present invention is a hinge assembly for engaging an appliance door to an appliance, such that rotational forces generated by the door as a function of the door position are balanced against a rotation force exerted about an axis of rotation for the door. The hinge assembly may be engaged to an interface using a locking bar to prevent translation of the adapter plate relative to the interface. The hinge assembly may further have a plunger incorporating an ovoid shaped retention pin bore for retaining an elastic element to the plunger.

20 Claims, 13 Drawing Sheets

Fig. 5A
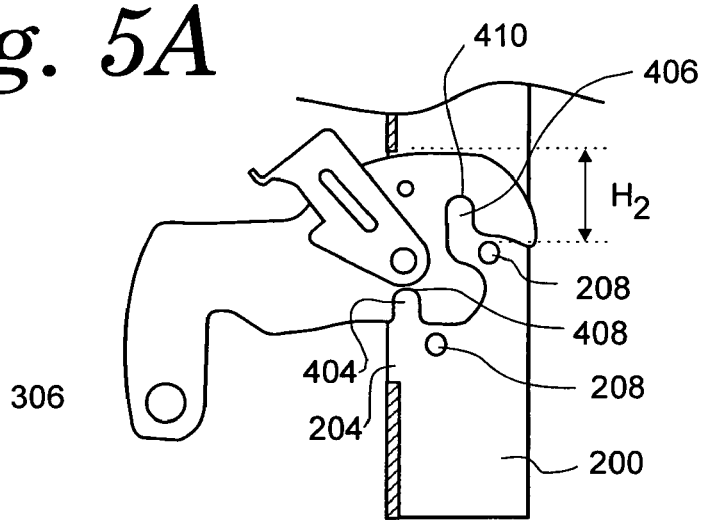
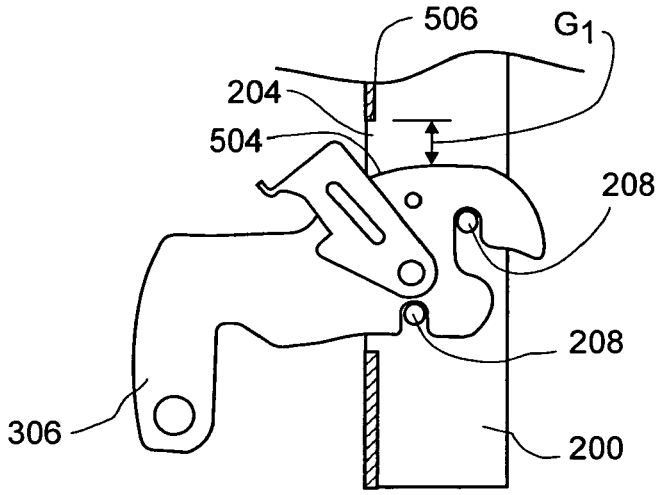
Fig. 5B
Fig. 5C
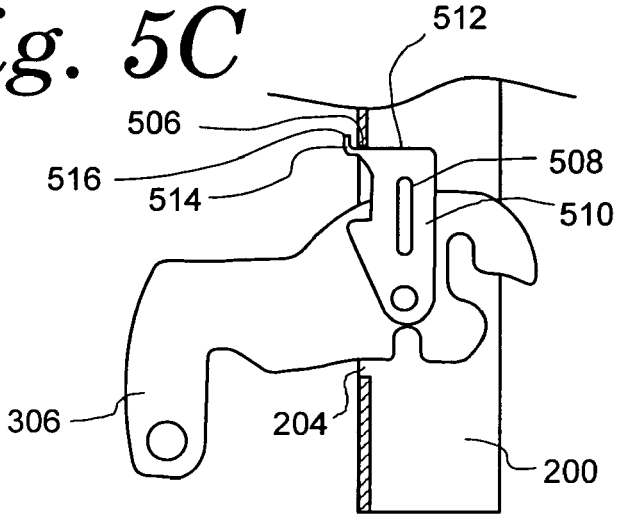

Fig. 6
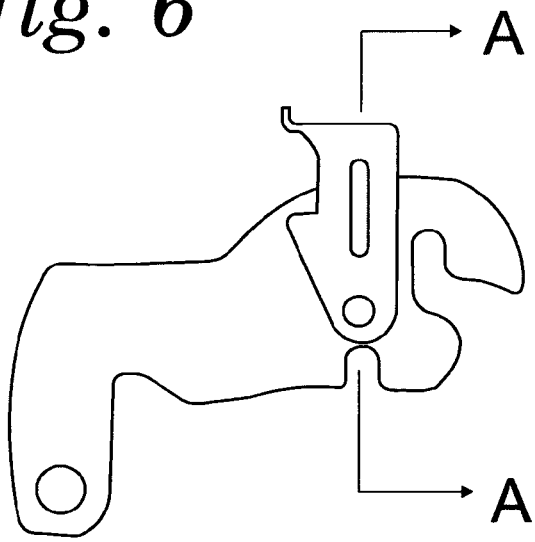
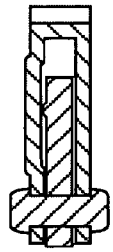
Fig. 6A
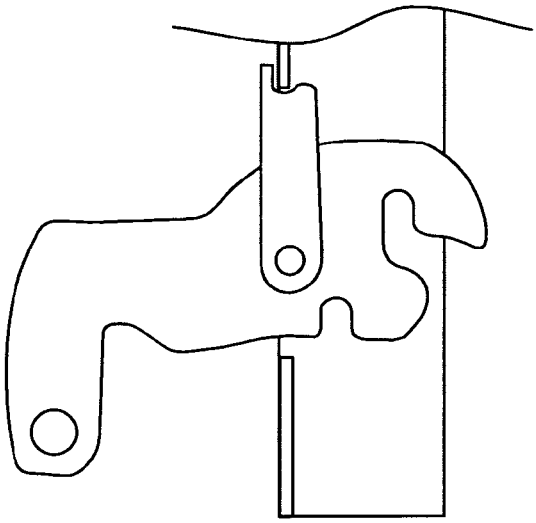
Fig. 7
Fig. 8
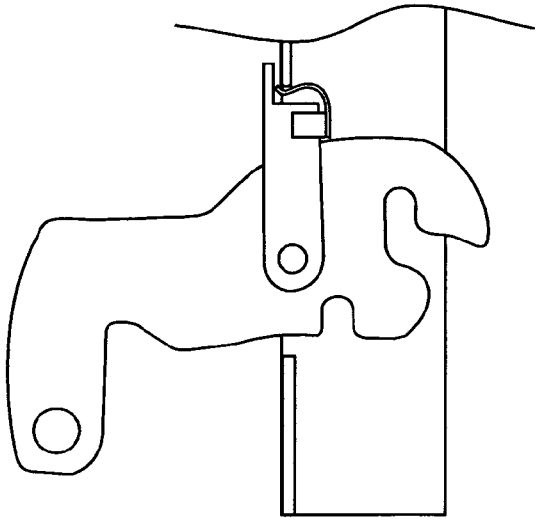

Fig. 15A
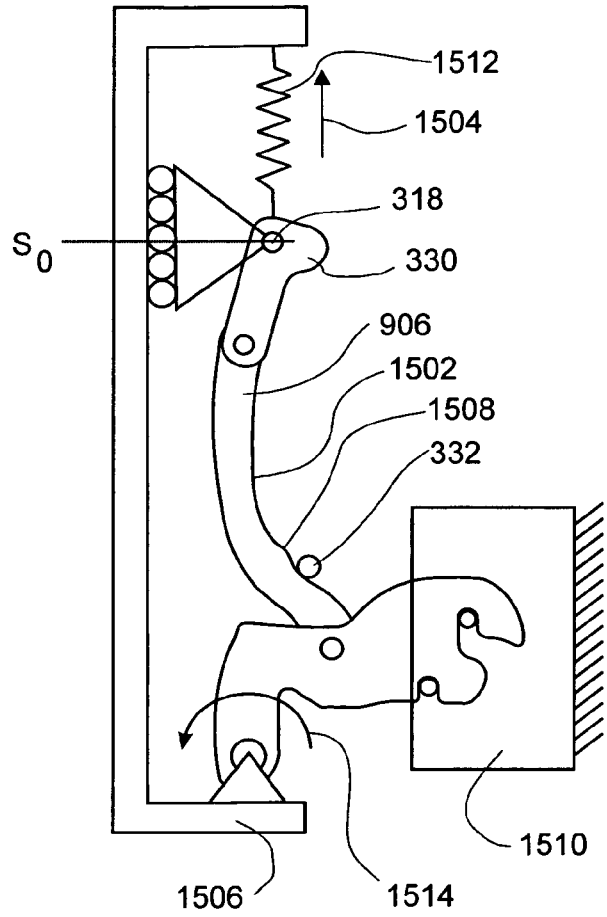
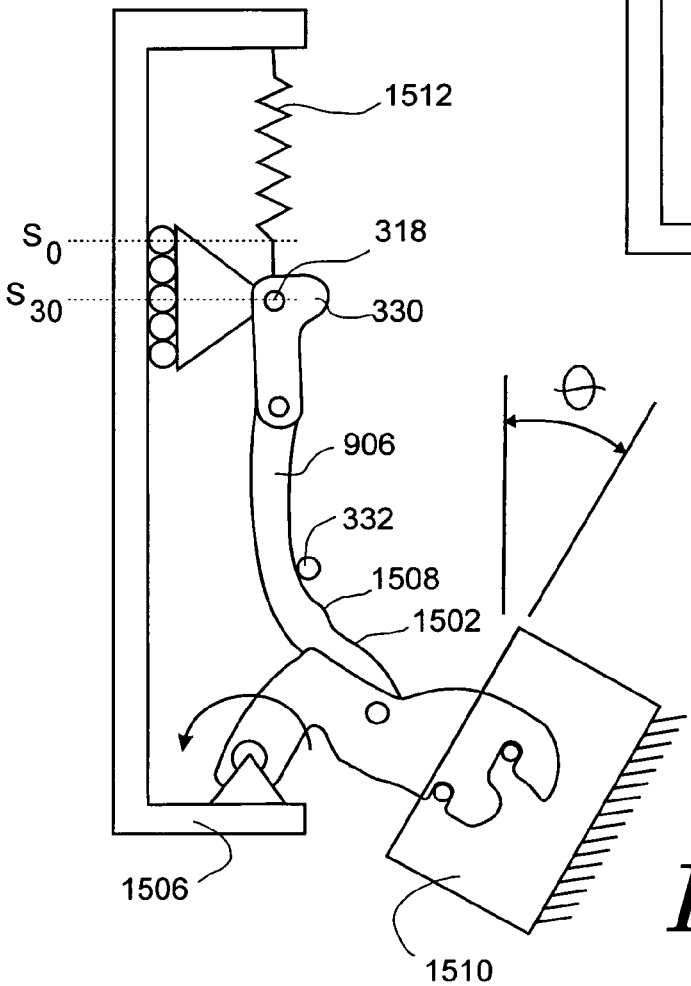
Fig. 15B

*Fig. 15C*
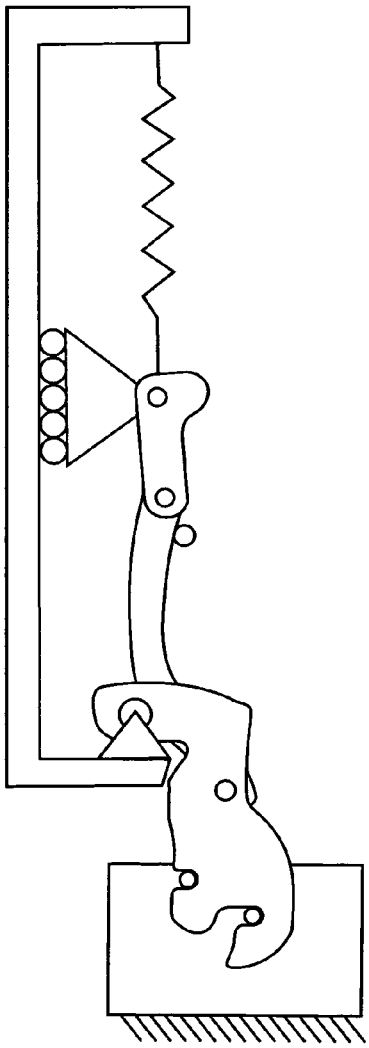
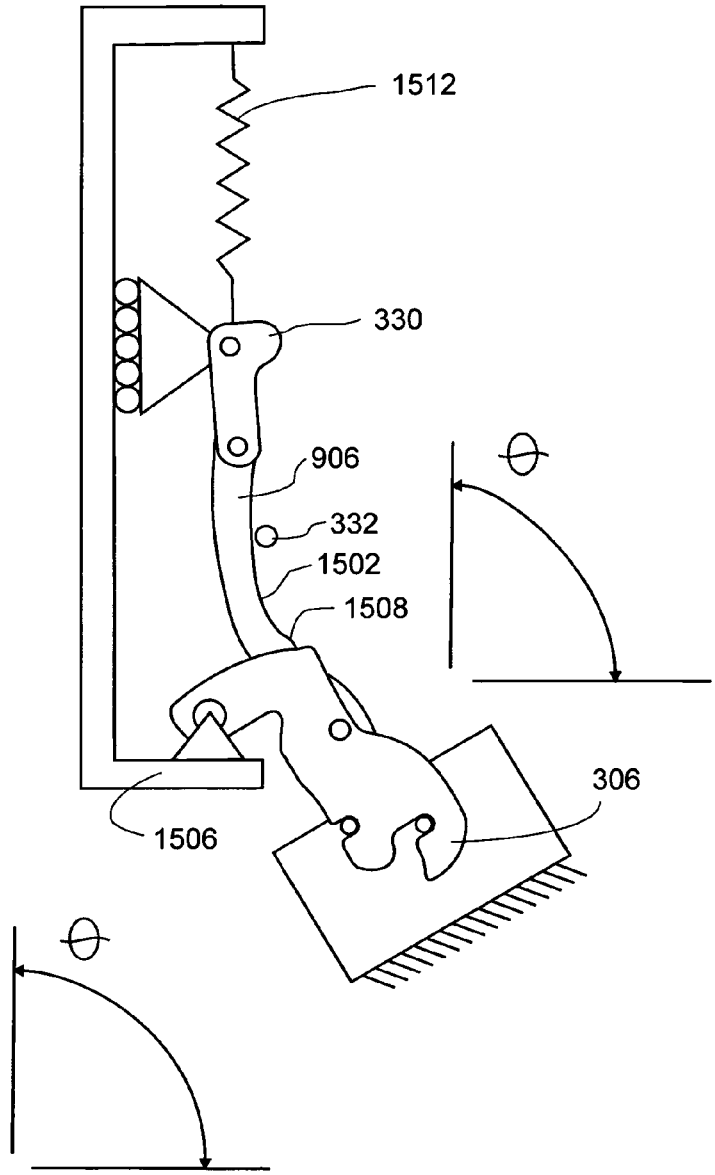
*Fig. 15D*

Fig. 17
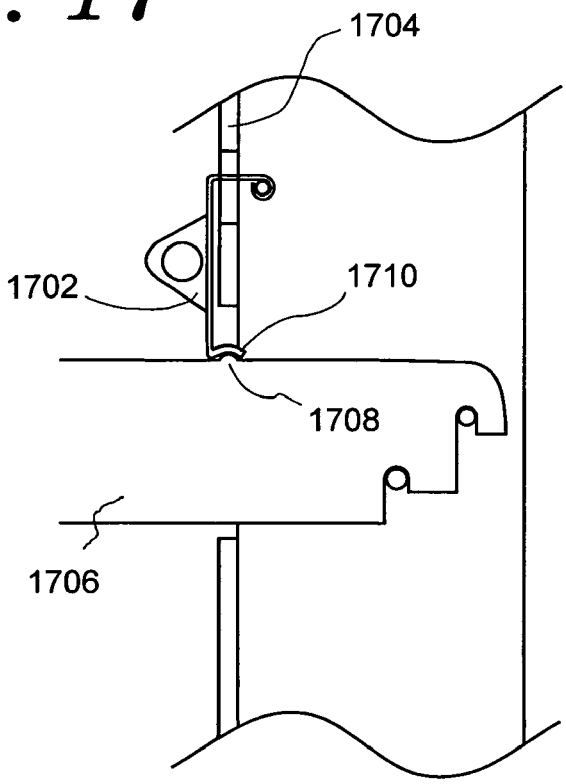
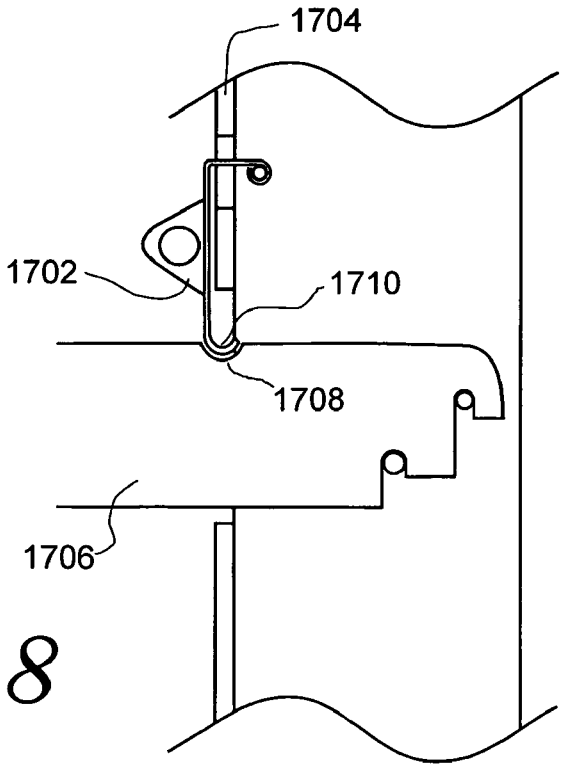
Fig. 18

APPLIANCE HINGE

PRIORITY INFORMATION

The present application claims priority from U.S. Provisional Patent Application Ser. No. 60/567,768, filed May 3, 2004.

FIELD OF THE INVENTION

The present invention relates generally to hinges, and more particularly to hinges for front opening appliances.

BACKGROUND OF THE INVENTION

The general construction of ovens and ranges and other appliances are well known in the art. Typically, for example, an oven or range includes a cooking chamber with a door for access to the chamber. The chamber is generally cube shaped, with top, bottom, left and right with a back wall opposite an opening for access to the chamber. The opening is closed by a door. Usually the door is attached to the cooking chamber along the bottom edge and pivots about a horizontal axis between open and closed positions.

Oven doors may be removable from the cooking chamber. This can be accomplished with several configurations, such as those shown in U.S. Pat. Nos. 3,040,732; 3,015,125; 3,072,117 and 3,677,259.

BRIEF DESCRIPTION OF THE FIGURES

Understanding of the present invention will be facilitated by consideration of the following detailed description of the present invention taken in conjunction with the accompanying drawings, in which like references refer to like parts and in which:

FIGS. 5A, 5B, and 5C illustrate an engagement of the adapter plate of FIG. 4 to the interface of FIGS. 2A, 2B, and 2C.

FIGS. 6 and 6A illustrate an adapter plate incorporating a rotating locking bar, with a detent bump on the body of the adapter plate, according to an aspect of the present invention.

FIG. 7 illustrates an adapter plate incorporating a rotating locking bar, with a detent bump on the locking bar according to the aspect of the present invention.

FIG. 8 illustrates an adapter plate incorporating a rotating locking bar, with the locking bar incorporating a spring element to form a detent between the locking bar and the contact edge of the interface, according to an aspect of the present invention.

FIGS. 15A, 15B, 15C, and 15D illustrate a linkage mechanism according to an aspect of the present invention.

FIGS. 17 and 18 illustrate a hinge assembly, using a rotatable locking bar affixed to the interface, wherein the locking bar incorporates a detent for retaining the locking bar in position according to an aspect of the present invention.

DETAILED DESCRIPTION OF THE PREFERRED EMBODIMENTS

The present application claims priority from U.S. Provisional Patent Application Ser. No. 60/567,788, filed May 3, 2004, the contents of which are incorporated herein by reference thereto.

Figure 1:
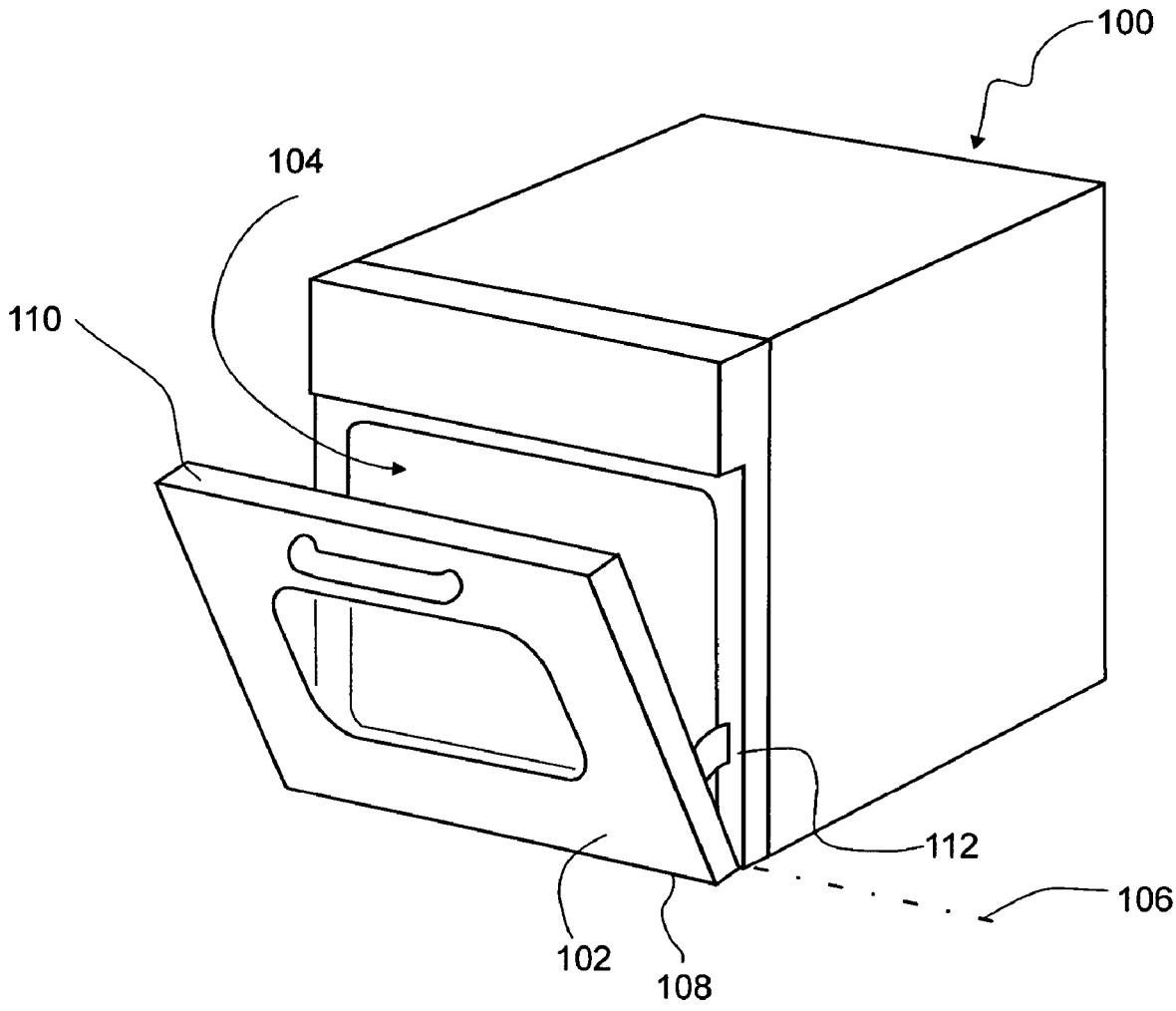
FIG. 1 illustrates an appliance to which an appliance door has been attached.
Figure 2C:
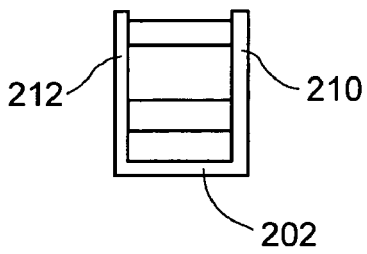
FIGS. 2A, 2B, and 2C illustrate various views of an appliance interface bracket according to an aspect of the present invention.
Figure 2A:
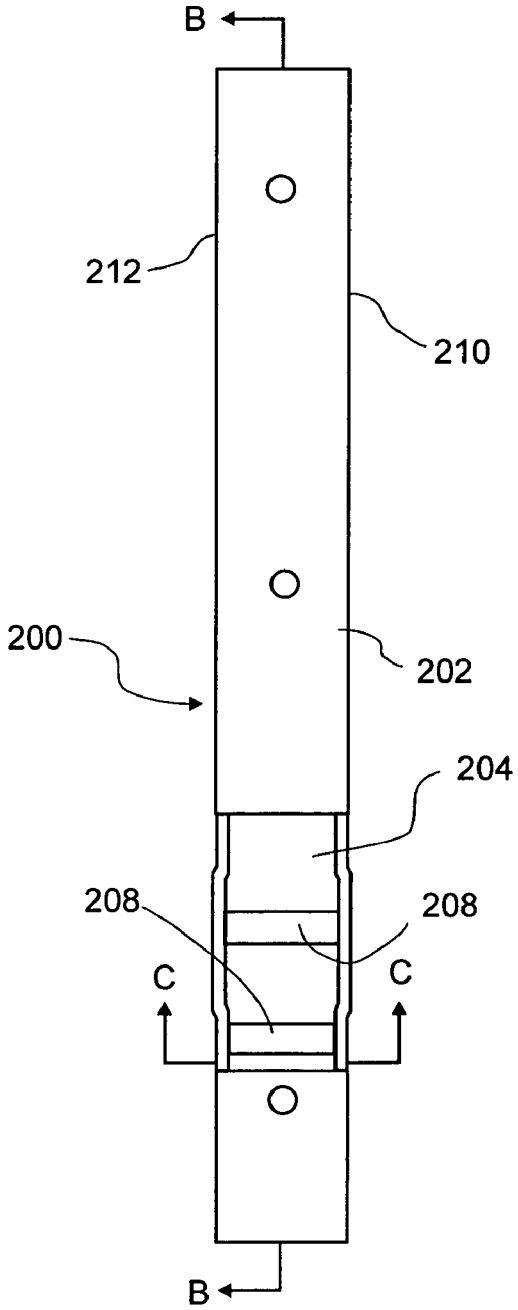
Figure 2B:
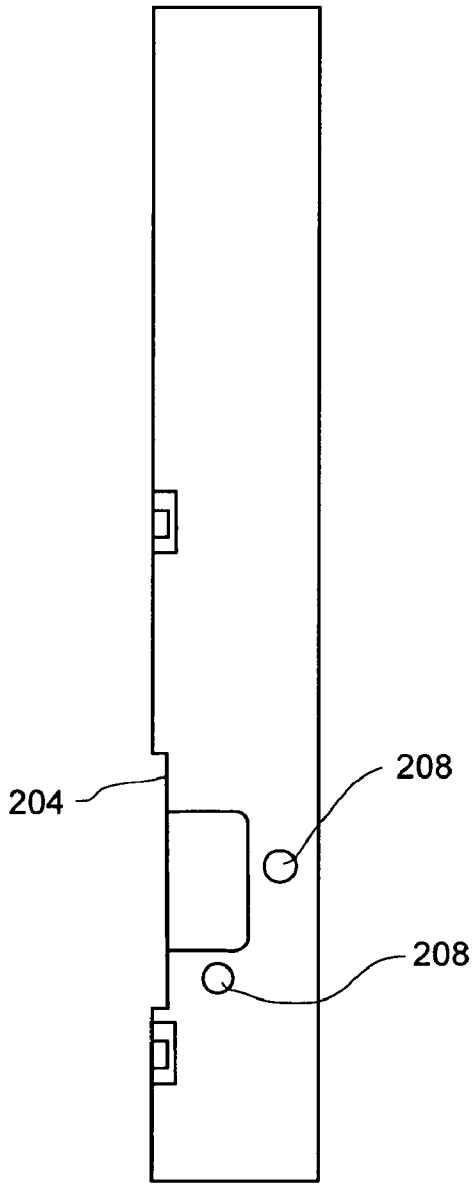

Preferred embodiments of the present invention are shown in the attached Figures, wherein like numbers represent like elements. As shown in FIG. 1, appliances 100, including but not limited to, ovens may use a downwardly opening front door 102 to provide access to the interior 104 of the appliance 100. Such a door 102 typically hinges about a rotation axis 106 adjacent to the bottom 108 of the door, such that the top 110 of the door rotates outward and downward from the appliance 100. As shown in FIGS. 2A, 2B, and 2C, the appliance may be provided with an interface 200 for attaching the door 102 (not shown in Figure). The interface 200 may include a u-shaped portion 202 having an aperture 204 therethrough to allow access to a pair of interface pins 208 mounted across the legs 210, 212 of the u-shaped channel 202. Alternately, the pins 208 and aperture 204 may be formed integrally with the appliance 100, or with the appliance door 102. Typically, the door 102 may be connected to the appliance 100 through a pair of hinge assemblies 112 (shown in FIG. 3) and interfaces 200 located at opposite edges of the door 102.

Figures 3A, 3B:
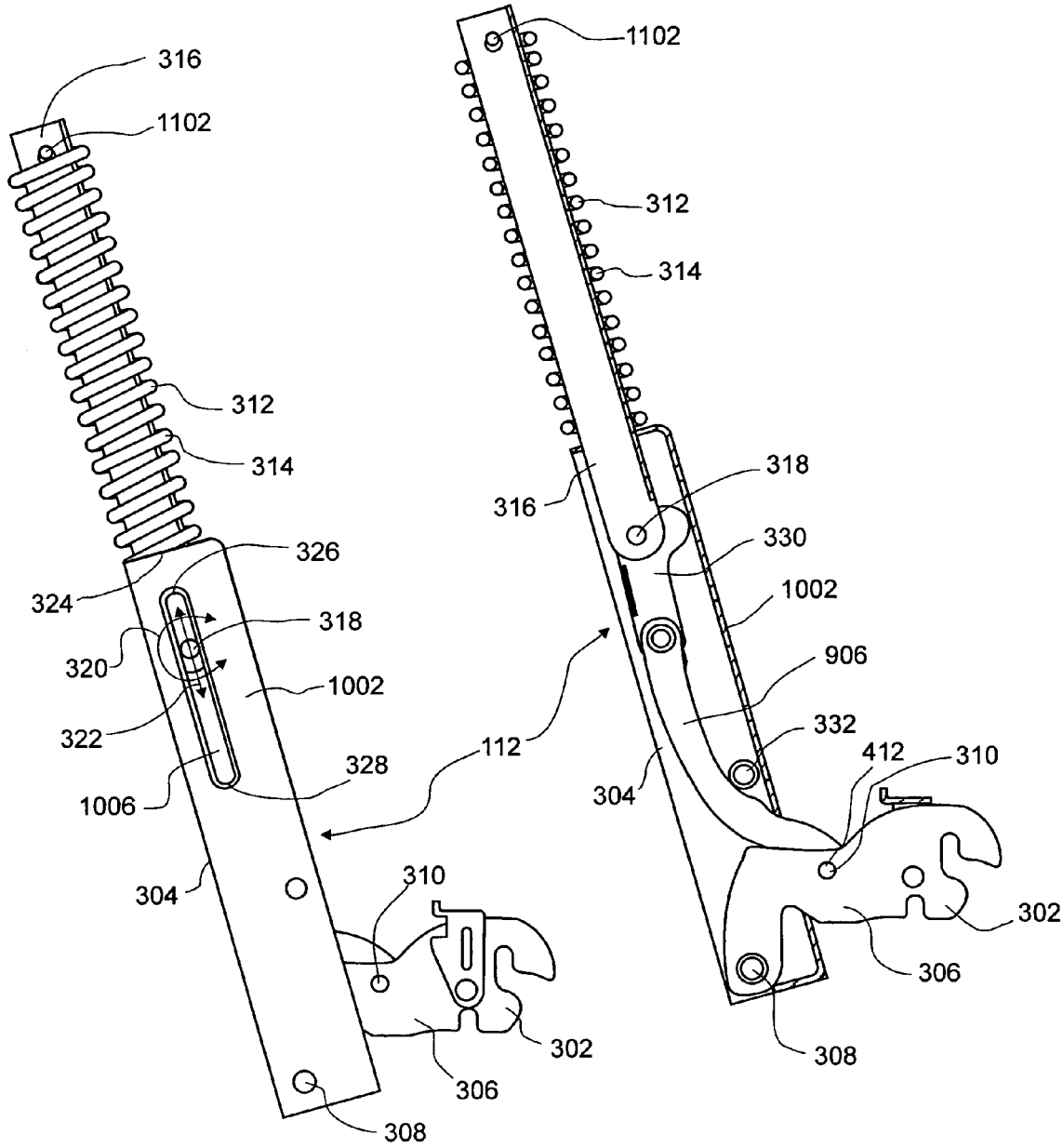
FIG. 3A illustrates a hinge assembly according to an aspect of the present invention.
FIG. 3B illustrates the hinge assembly of FIG. 3A, shown in partial cross-section.

As shown in FIGS. 3 and 3A, the hinge assembly 112 may include a mounting portion 302 and a loading portion 304. The mounting portion 302 may provide for the rapid engagement or disengagement of a hinge assembly 112 from an appliance 100. The loading portion 304 of the hinge assembly 112 may facilitate opening and/or closing of the door 102, and optionally may provide for an appliance door 102 to which the hinge assembly 112 is mounted to be retained at a partially open position, or at a fully open position, for example.

Figure 4:
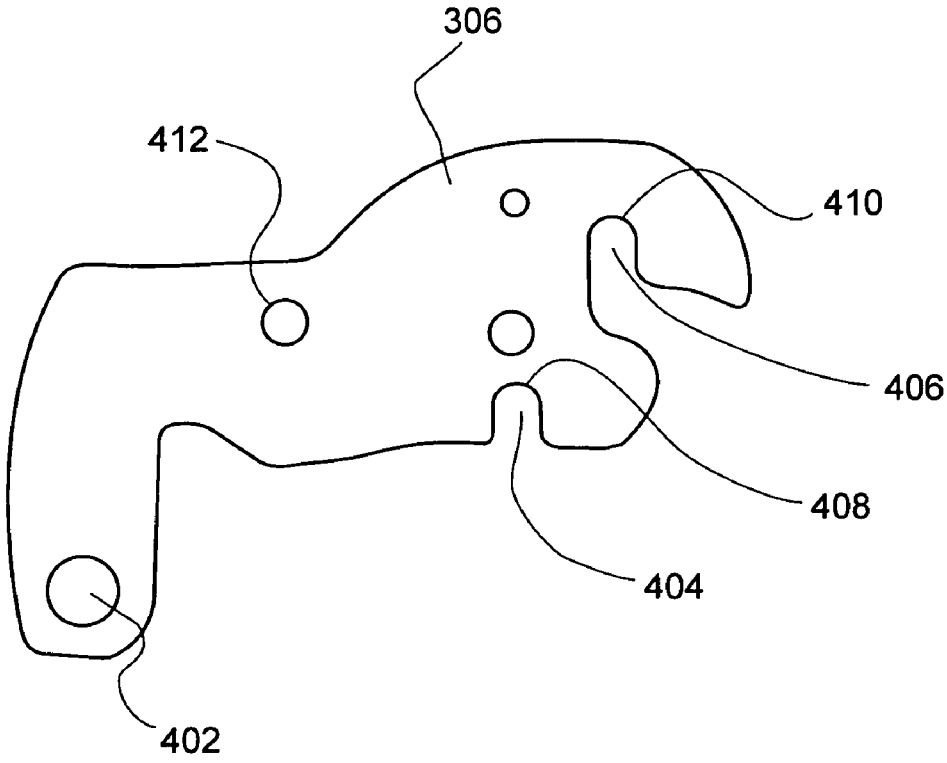
FIG. 4 illustrates an adapter plate according to an aspect of the present invention.

The mounting portion 304 may include an adapter plate 306. The adapter plate 306, as shown in FIG. 4, may have a bore 402 for inserting a hinge pin 308 (not shown in Figure). At an opposite end of the adapter plate 306, the adapter plate 306 may have a pair of downward opening u-slots 404, 406 positioned such that the closed end 408, 410 of the u-slots 404, 406 accommodate interface pins 208 when the adapter plate 306 is assembled over the interface pins 208. The adapter plate 306 may also be provided with a locking bar 510 (shown in FIGS. 5A-5C) for limiting travel of the adapter plate 306 within the interface aperture 204 when the adapter plate 306 is positioned over the interface pins 208.

As shown in FIGS. 5A, 5B, and 5C, assembly of the adapter plate 306 to the interface 200 may be accomplished by inserting the adapter plate 306 into the aperture 204. As may be seen in FIG. 5A, the height $H_2$ of the adapter plate 306 from the closed end 410 of u-slot 406 may be selected such that the adapter plate 306 is able to be inserted into the aperture before the interface pins 208 are in the u-slots 404, 406. The required height may be reduced by allowing rotation of the adapter plate 306 as it passes into the aperture 204. As shown in FIG. 5B, the u-slots 404, 406 may be substantially parallel, such that lowering the adapter plate 306 over the interface pins 208 may be done so that the closed ends 408, 410 of the u-slots 404, 406 rest against the interface pins 208 and cause a gap $G_1$ to be created between a top edge 504 of the adapter plate 306 and a contact surface 506 of the of the interface 200 adjacent to and partially defining the aperture 204. This gap $G_1$ may serve to allow the adapter plate 306 to be engaged or disengaged from the interface pins 208.

As shown in FIG. 5C, incorporating a locking feature 508, such as a rotatable locking bar 510, allows the adapter plate 306 to be substantially secured into the interface 200. When the bar 510 is oriented such that a blocking edge 512 is adjacent to a contact surface 506 of the interface 200, the bar 510 serves to prevent translation of the adapter plate 306, required to move the u-slots 404, 406 away from the interface pins 208. The bar 510 may preferably be located such that when the bar 510 is in a locked position, such as shown in FIG. 5C, the bar 510 is in compression if an attempt to move the adapter plate 306 away from the interface pins 208 occurs.

The outer end 514 of the locking bar 510 may have a lip 516 provided to allow easier positioning of the locking bar 510. When the locking bar 510 is being pushed into a locked position, the lip 516 may provide a larger surface area for the application of force. If it is desired to retract the locking bar 510 from the locked position, the lip 516 may be used to provide an edge that can be engaged to rotate the locking bar 510 out of the locked position. The lip 516 may also form a limit such that the locking bar 510 may not be over-rotated past the contact surface 506 of the aperture 204.

Retention of the locking bar 502 in a locked position may be desired. Such a fixing action may be accomplished through the use of elastic deformation caused by a detent. As shown in FIGS. 6 and 6A, a detent may be formed between the locking bar 510 and the adapter plate 306 through the inclusion of a raised feature 602 on the adapter plate 306, and a recessed portion 604 on the locking bar 510 in a location such that the raised feature 602 is within the recessed portion 604 when the locking bar 510 is in a locked position. The recessed portion 604 may be in the form of a recessed slot, such that alignment concerns between the raised portion feature 602 the recessed portion 604 may be at least partially alleviated. Alternately, the raised feature 602 may be incorporated into the locking bar 510, with the recessed portion 604 incorporated into the adapter plate.

As shown in FIG. 7, the detent may also be formed on the end 702 of the locking bar 510, such that a raised ramp 704 on the contact face 706 of the locking bar 510 may be forced past the contact surface 506 of the aperture 204 before the locking bar 502 may be oriented in a locked position.

As shown in FIG. 8, a spring clip 802 having a ramp portion 804 and a wedge portion 806 may alternately be affixed to the locking bar 510. Again, the ramp portion 804 may be forced past the contact surface 506 of the aperture 204 before the locking bar 510 may oriented in a locked position. The inclusion of a wedge portion 806 could allow a biasing of the locking bar 510 in a downward direction, such that when the locking bar 510 is in a locked orientation, the biasing would limit lash (a gap between the surfaces) present between the locking bar 510 and the contact surface 506 of the aperture 204.

Figure 9A:
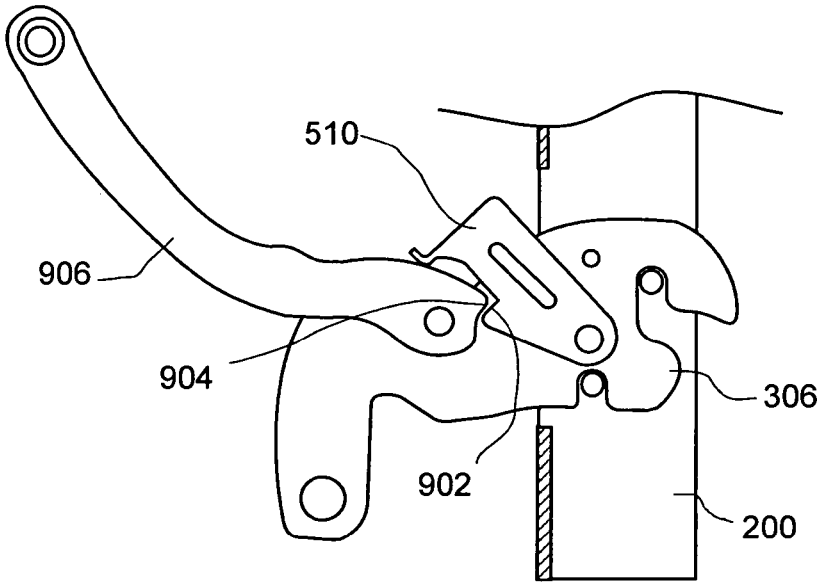
FIGS. 9A and 9B illustrate a retention feature of a hinge assembly which may be incorporated to allow the locking bar to be held in an unlocked position by the follower when the follower is in an open or partially open condition, according to an aspect of the present invention.
Figure 9B:
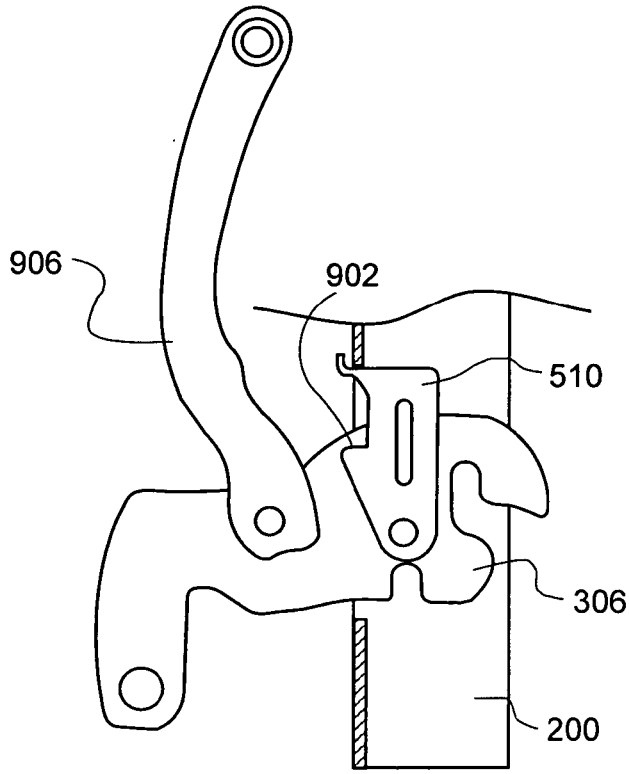

As shown in FIGS. 9A and 9B, a receiver 902 may be provided on the locking bar 510, such that when the locking bar 510 is in an unlocked position (shown in FIG. 9A), a related shoulder 904 on a follower 906 may engage the receiver 902 to prevent rotation of the locking bar 510 to a locked position. The engagement of the follower 906 to the receiver 902 may also limit the rotation of the follower, such that the follower 906 may be fixed such that the hinge assembly 112 is maintained in a partially open or open position to cause engagement of the adapter plates 306 to the interface 200. The shoulder 904 and receiver 902 may thus require that the an angle between the loading portion 304 and the adapter plate 306 be increased to allow the shoulder to clear the receiver 902, such that the locking bar 510 may be moved away from the retained open position only when the angle is increased.

Figure 10B:
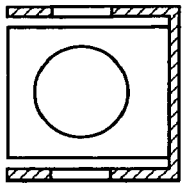
FIGS. 10, 10A, and 10B illustrate a frame according to an aspect of the present invention.
Figure 10:
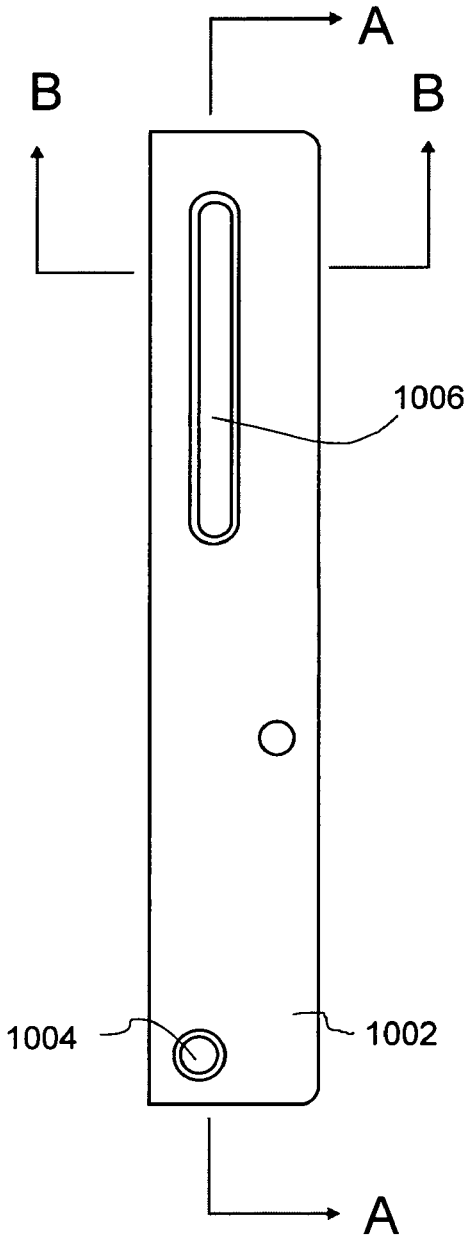
Figure 10A:
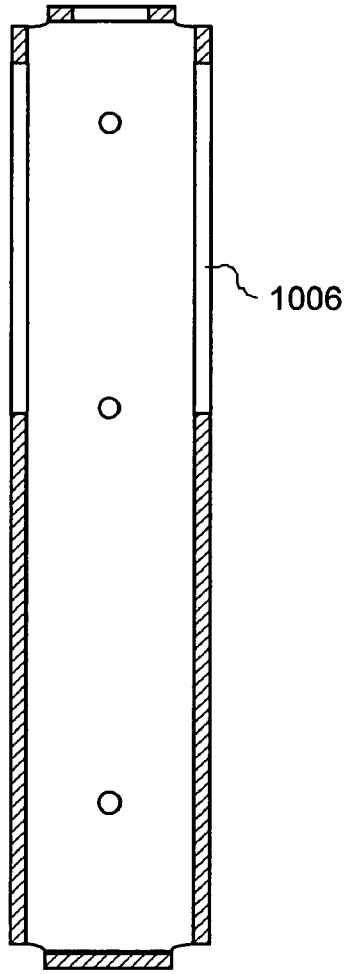

The loading portion 304 of the hinge assembly may have a frame 1002 as shown in FIG. 10 for mounting components which comprise the loading portion. The frame 1002 may have a clevis bore 1004 or bores through which a hinge pin (not shown) may be inserted to form a hinge joint. When the loading portion 304 is assembled over the adapter plate 306, the hinge pin (not shown) may extend through the clevis bore 1004 in the loading portion 304, then through the hinge bore 402 in the adapter plate 306 (not shown). The frame 1002 may have a u-shaped section (shown in FIG. 10B) adjacent to the clevis bore 1004, such that the clevis bore 1004 extends through both legs of the u-shaped section, such that a hinge pin would be supported on both sides of the hinge bore 402 of the adapter 306. A single sided clevis bore 1004 may be used, however this may detract from the stability of the joint formed by the hinge pin (not shown) through the clevis bore 1004 and the hinge bore 402.

The adapter plate 306, as shown in FIG. 4, may be provided with a follower joint 412 for connecting a follower 906 (not shown) at a position offset from the hinge bore 402. By offsetting the follower joint 412 from the hinge bore 402, force applied at the follower joint 412 may be used to create a torque around the axis of the hinge bore 402.

As shown in FIG. 3B, the follower 906 may be connectable to the follower joint 412 The joint between the follower 906 and the follower joint 412 may be formed through the inclusion of a hole through the adapter plate 306 through which a follower to adapter plate pin 310 may be inserted. The follower 906 may also be provided with a hole for receiving the adapter plate pin 310, such that when the adapter plate 306 pin 310 is inserted through the holes in the adapter plate 306 and the follower 906, a rotational follower joint is formed having a rotational axis of freedom through the axis of the adapter plate pin 310.

Figure 11:
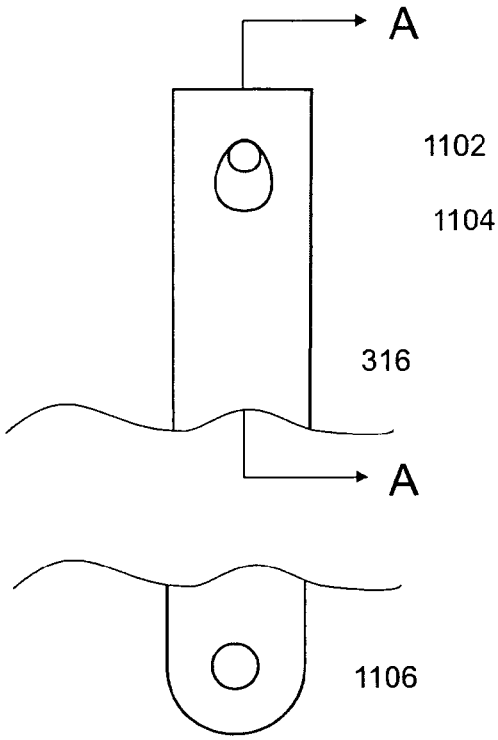
FIG. 11 illustrates aspects of a plunger according to an aspect of the present invention.
Figure 12:
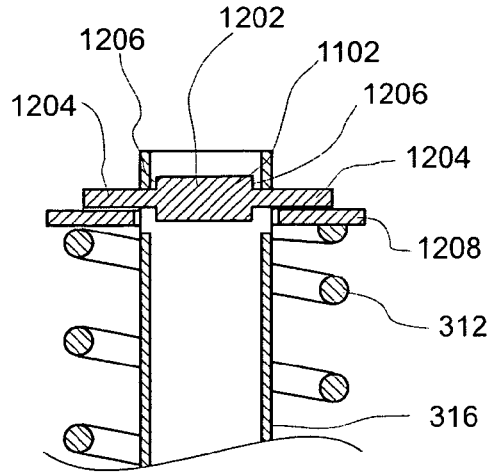
FIG. 12 illustrates a retention pin having a larger diameter center portion according to an aspect of the present invention.

The follower 906 may form a linkage element between the adapter plate 306 and a biasing element 312 for applying force to the adapter plate 306. The biasing element 312 may comprise a spring 314 surrounding a plunger 316. As shown in FIG. 11, the plunger 308 may be formed as a u-shaped channel having first and second legs and a web connecting the legs. The plunger 308 may have a retention pin 1102 insertable through an ovoid shaped hole 1104 in the end of the plunger 316 to form a biasing element retainer. As shown in FIG. 12, the retention pin 1102 may be formed with a center portion 1202 and two outer portions 1204, with the center portion 1202 having a larger diameter than the outer portions 1204. The ovoid shaped hole 1202 may be sized such that the center portion 1202 may pass through the large end of the ovoid shaped hole 1104. The outer portions 1204 of the retention pin 1102 may have outer diameters such that the outer portions 1204 of the retention pin 1102 may be translated into the small end of the ovoid shaped hole 1104, such that the shoulders 1206 center portion 1202 prevents the retention pin 1102 from sliding out of the ovoid shaped hole 1104 when the retention pin 1102 outer portions 1204 are in the small end of the ovoid shaped hole 1104.

The retention pin 1102 may be of sufficient length such that an elastic element 312 abuts the retention pin 1102 when the elastic element 312 is placed around the plunger 316. Accordingly, the elastic element 312 would not be able to extend past the retention pin 1102 when the elastic element is assembled over the plunger 316 and the retention pin 1102 center portion 1202 is in the small end of the ovoid shaped hole 1104. Additionally, a washer shaped spring keeper 1208 may be incorporated between the elastic element 312 and the retention pin 1102 to help distribute the load of the elastic element 312 on the retention pin 1102.

Figure 13:
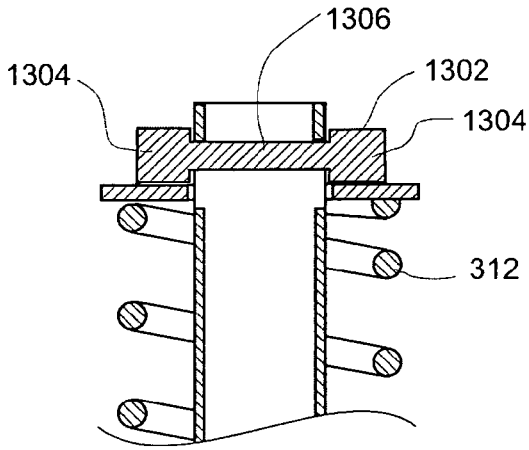
FIG. 13 illustrates a retention pin having larger diameter outer portions according to an aspect of the present invention.
Figure 14:
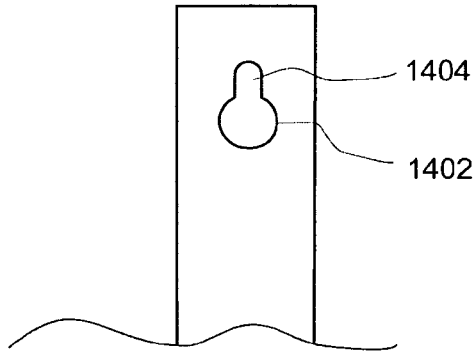
FIG. 14 illustrates aspects of a plunger according to an aspect of the present invention.

As shown in FIG. 13, the retention pin 1302 may be alternately configured such that the outer portions 1302, 1304 have a larger diameter than the center portion 1306, such that the smaller diameter of the center portion 1306 rests in the small end of the ovoid hole 1104. As shown in FIG. 14, the hole may alternately be formed as a circular portion 1402 with a slot 1404 extending from the circular portion 1402.

As shown in FIG. 11, the plunger 308 may be provided with a slider hole 1106 through the plunger 308 on an end opposite from the end through which the ovoid shaped hole 1104 is located. As shown in FIG. 3, the frame 1002 may have a frame slot 1006 through which a slider pin 308 may be inserted, such that when the plunger 316 is inserted into the frame 1002, and a slider pin 318 is inserted through the slider hole 1106, a joint between the plunger 316 and the frame 1002 is formed, having both a rotational degree of freedom 320, as well as a translational degree of freedom 322. The frame 1002 may have a shoulder 324 such that when the plunger 316, with an elastic element 312 installed over the plunger 316, is assembled to the frame 1002, the elastic element 312 bears against both the retention pin 1102 and the frame shoulder 324. Accordingly, the elastic element 312 would be in compression when assembled onto a plunger 316, with the plunger 308 having both a retention pin 1102 and a slider pin 318.

The frame slot 1006 may extend parallel to a long axis of the frame 1002, such that a slider pin 318, when installed into the slot 1006, is able to translate relative to the long axis of the frame 1002. Accordingly, the plunger 308 may travel along this axis, such that when the slider pin 318 is at a distal end 326 of the slot, the elastic element is at a minimum compression, and such that when the slider pin is at the proximal end 328 of the slot 1006, the elastic element 312 is in a maximum compression.

A link 330 may also be engaged by the slider pin 318, such that the link 330 moves with the slider pin 318 and plunger 316 The link 320 may further be connected to the follower 906 such that the follower 906 is biased to pull against the adapter plate 306 when the elastic element 312 is installed unless the slider pin 318 is at the distal end 326 of the slots. The joints between the plunger 316 and the link 330, and between the link 330 and the adapter plate 306 may preferably have rotational degrees of freedom, such that the link 330 can rotate relative to the slider pin 308, and the adapter plate 306 can rotate relative to the link 330.

The frame may additionally have a fulcrum in the form of a roller 332. As shown in FIG. 15A, the follower 906 may preferably have a follower surface 1502 which bears against the roller 332. Accordingly, outward translation of the plunger (not shown) would cause the link 330 to be pulled distally 1504, and thus to cause the follower 906 to be pulled distally as well. As the follower surface 1502 of the follower 906 abuts the roller 332, translation of the follower 906 forces the follower 906 to move both laterally and rotationally relative to the frame 1506. The rotational degrees of freedom between the link 330 and the plunger (not shown), and between the link 330 and the follower 906, prevent the follower 906 from binding due to the constraints with the adapter plate 306 and the roller 332. The follower surface 1502 and the roller 332 thus form a cam means controlling translation of the follower.

The loading portion 304 assembly may thus bias the adapter plate 306 to rotate to a closed position relative to the frame 1002, such as shown in FIG. 14. When an appliance door is connected to an appliance, the rotational force required to hold the door in a position, due to gravity, will vary based on the position of the door. A door in a vertical position, with the center of gravity of the door generally above the hinge axis, will exert minimal rotational force about the hinge axis. As the door descends to lower positions, the rotational force will increase, as the center of gravity of the door moves laterally away from vertical axis of the hinge axis. Accordingly, the amount of force biasing the hinge assembly to the closed portion, in order to balance the weight of the door, may vary based on the position of the door. A linearly increasing force may be provided by simply connecting the elastic element to the adapter plate. Such a force, however, may not successfully balance the closure force against the rotational force generated by the door. By implementing the profile of the follower surface of the follower, the mechanical advantage between the elastic element 304 and the adapter plate 306 can be varied to allow the closure force to approximate the rotational force.

The addition of a bump 1508 on the follower surface 1502 may be used to cause a detent force at a specific position. Accordingly, placement of the bump 1508 may be implemented to allow the detent position to occur at a preferable position, for a partially opened door, such as for a preferred position for broiling. Multiple bumps 1508 may be provided to create multiple detents associated with multiple preferred positions.

In FIGS. 15A, 15B, 15C, and 15D, the frame 1506 is shown in a vertical orientation for convenience, although either the frame 1506 or the appliance 1510 to which the adapter plate 306 is mounted may be retained in a fixed vertical orientation. As shown in FIG. 15A, when the door is in a closed orientation, the elastic element 1512 pulls against the link plate 330, which pulls against the follower 906, which biases the adapter plate 306 to rotate in a counterclockwise direction 1514. Based on the linear degree of freedom of the slider pin 318, the follower 906 is biased against the roller 332.

As shown in FIG. 15B, when an angle $\theta$ is opened between the frame 1506 and the appliance 1510 to which the adapter plate 306 is engaged, the follower 906 is pulled downward (the slider position shifts from $S_0$ to $S_{30}$, increasing the tension in the elastic element 1512. Because of the roller 332 and the follower surface 1502 of the follower 906, the follower 906 and the link 318 are forced to rotate during this translation. As shown in FIG. 15C, as the angle θ increases further, the follower 906 and the link 330 rotate further. This rotating action creates a deflection of the elastic element 1512 which is not linearly related to the angle θ between the door and the appliance. As the rotational force created by the weight of the door is a function of the angle of the door from the vertical, where the door is hinged at the bottom, the rotational force is approximately equal to the weight of the door times the distance between the center of gravity of the door times the sine of the angle from the vertical of the door. Accordingly, with proper selection of the follower surface 1502 of the follower 906 and proper positioning of the roller 332, the linear deflection of the elastic element may approximate a sine function based on the angle θ between the frame 1506 and the adapter plate 306. Accordingly, the force applied by the elastic element 1512 may approximate the varying rotation force created by the weight of the door as the door is rotated open. As precisely balancing the rotational force against the closure force provided by the biasing element may not be practical, friction between the varying joints of the assembly may be beneficial in allowing the door to be selectively positioned, wherein the friction force in the joints must be overcome to open or close the door. Accordingly, the amount of friction in the joints may provide a stabilizing force such that the stabilizing force must be overcome for opening or closing of the door to occur. Accordingly, if a small imbalance between the rotational force and the biasing force is present, as long as the imbalance is less than the force required to overcome the friction in the joints, the door will be stable in any position between opened or closed.

The addition of contours 1508 to the follower surface 1502, as discussed above, may be used to increase the biasing force locally, such that an additional force may be required to rotate the door past the position associated with a bump 1508.

The above discussion of the hinge assembly of the present invention contemplates attachment of the hinge assembly to the appliance door, with the interface being a portion of the appliance. This discussion, however, is not intended to be limiting. The hinge assembly may be formed as an element of the appliance, with the interface formed in the appliance door. Additionally, the use of two hinge assemblies, located at either side of the door, may provide for smoother opening and closing of a door.

Figure 16:
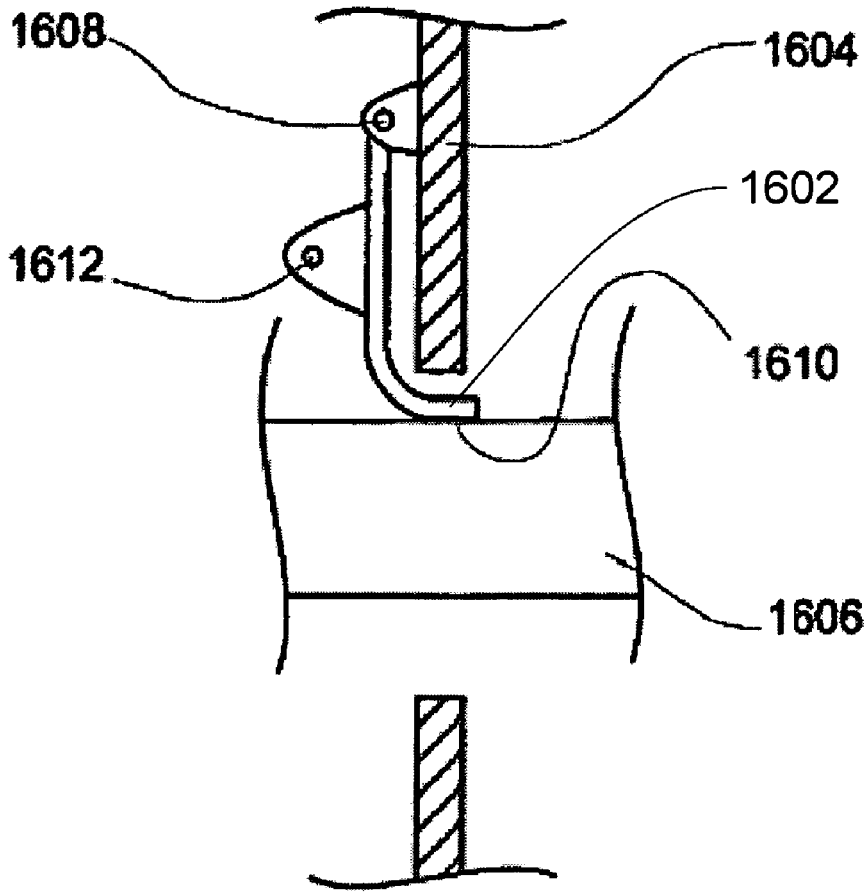
FIG. 16 illustrates hinge assembly, using a rotating locking bar affixed to the interface according to an aspect of the present invention.

As shown in FIG. 16, a rotatable locking bar 1602 may be affixed to the interface 1604, rather than the adapter plate 1606. The locking bar 1602 may be provided with a hinge point 1608 and a bearing surface 1610 which bears against the adapter plate 1606 when the locking bar 1602 is in a locked position. The locking bar 1602 may further have a tab 1612 to assist service personnel in pulling the locking bar 1602 outward to release the adapter plate 1606. As shown in FIG. 17, the rotating locking bar 1702 affixed to the interface 1704 may further incorporate a detent 1706 to assist retention of the locking bar 1702 in a locked position. The detent 1706 may comprise a raised portion 1708 on the adapter plate 1706, and a recess 1708 on the locking bar 1702, as shown in FIG. 17, or vice versa, wherein the recess 1702 is on the adapter plate 1706, such as is shown in FIG. 17.

The present invention may be embodied in other specific forms than the embodiments described above without departing from the spirit or essential attributes of the invention. Accordingly, reference should be made to the appended claims, rather than the foregoing specification, as indicating the scope of the invention.

What is claimed is:

1. An appliance hinge, said appliance hinge comprising:

a frame, said frame having a first frame end and a second frame end and a frame axis extending through said first frame end and said second frame end, a slot adjacent said second frame end, said slot having a long axis, said long axis being substantially parallel to said frame axis;

a plunger, said plunger having a first plunger end and a second plunger end, a biasing element retainer adjacent said first plunger end and a plunger joint adjacent said second plunger end;

a biasing element, said biasing element biasing the first plunger end away from the frame;

a link, said link having a first link end, a second link end, and a link joint, said link joint being located adjacent said second link end;

a follower, said follower having a first follower end, a second follower end, a follower axis extending through said first follower end and said second follower end, and a follower surface, said follower surface having a profile;

a fulcrum, said fulcrum being mounted to said frame; and an adapter plate, said adapter plate having a first adapter end and a second adapter end, an appliance engagement, a hinge joint and a follower joint, said hinge joint being located adjacent said first adapter end and said appliance engagement being located adjacent said second adapter end, said follower joint being located at a distance from said first end;

wherein said link is rotatably connected to said plunger adjacent the first link end by said plunger joint;

wherein said follower adjacent the first follower end is connected to said link by said link joint;

wherein said plunger joint comprises a pin extending through said slot, said pin constraining motion of the plunger joint in a direction substantially parallel to said frame axis;

wherein said follower is connected to said adapter plate adjacent the second follower end via said follower joint;

wherein said adapter is rotatably connected to said frame adjacent the first frame end via said hinge joint;

wherein said follower surface bears against said fulcrum;

wherein when said adapter plate is rotated, the position of said follower is constrained by contact between said follower surface and said fulcrum; and wherein the contact between the fulcrum and the follower surface varies the motion of the follower such that force applied to the adapter plate through the follower joint varies with respect to the amount of force applied by the biasing element to the plunger.

2. An appliance hinge according to claim 1, wherein said follower surface profile is contoured such that translation of the follower surface relative to the fulcrum results in a varying resistance which substantially offsets the weight of an appliance door as said appliance door rotates to an open position.

3. An appliance hinge according to claim 1, wherein said follower surface is contoured such that the force applied to the adapter plate through the follower joint is increased at a localized position, such that an appliance door to which the appliance hinge is mounted is retained in a partially open position determined by the localized position.

4. An appliance hinge according to claim 3, comprising a second follower surface contour for retaining said appliance door at a second partially open position.

5. An appliance hinge according to claim 1, wherein said fulcrum comprises a roller.

6. An appliance hinge according to claim 1, wherein said biasing element comprises a spring.

7. An appliance hinge according to claim 6, wherein said spring surrounds said plunger and bears against a surface of said frame at a first spring end and against said biasing element retainer at a second spring end.

8. An appliance hinge according to claim 7, wherein said biasing element retainer comprises a pin extending from said plunger.

9. An appliance hinge according to claim 7, wherein said plunger comprises a unshaped channel formed by a first plunger leg and a second plunger leg, said first plunger leg and said second plunger leg being joined by a plunger web, and further comprising a first retainer bore through said first plunger leg and a second retainer bore through said second plunger leg, said first retainer bore and said second retainer bore being located adjacent said first plunger end, and further wherein said biasing element retainer comprises a pin extending through said first retainer bore and said second retainer bore.

10. An appliance hinge according to claim 9, wherein said first retainer bore and said second retainer bore each have a small end and a large end, said small ends having a small end diameter and said large ends having a large end diameter, said small ends being disposed towards said first plunger end, and wherein said retainer pin has a first end portion, a second end portion, and a center portion, said center portion having an outer diameter substantially the same as the small end diameter, and wherein the diameter of the first end portion and the second end portion is greater than the small end diameter such that when the retainer pin is inserted into the small ends of the retainer bores, the retainer pin is prevented from being withdrawn from the retainer bores.

11. An appliance hinge according to claim 9, wherein said first retainer bore and said second retainer bore each have a small end and a large end, said small ends having a small end diameter and said large ends having a large end diameter, said small end being disposed towards said first plunger end, and wherein said retainer pin has a first end portion, a second end portion, and a center portion, said first end portion and said second end portion having an outer diameter substantially the same as the small end diameter, and wherein the diameter of the center portion is greater than the small end diameter such that when the retainer pin is inserted into the small ends of the retainer bores, the retainer pin is prevented from being withdrawn from the retainer bores.

12. An appliance hinge according to claim 1, wherein said appliance engagement comprises a plurality of pin channels for engaging a plurality of mounting pins, and wherein said adapter plate further comprises a locking bar rotatably mounted to said adapter plate, said locking bar being rotatable into a locked position preventing said appliance engagement from being disengaged from said mounting pins.

13. An appliance hinge according to claim 12, wherein said locking bar further comprises a receiver and said follower further comprises a shoulder, and wherein said locking bar may be rotated into a position wherein said receiver engages said shoulder to limit rotation of the follower relative to the adapter plate.

14. An appliance hinge, said appliance hinge comprising:

a frame, said frame having a first frame end and a second frame end and a frame axis extending through said first frame end and said second frame end, a slot adjacent said second frame end, said slot having a long axis, said long axis being substantially parallel to said frame axis;

a plunger, said plunger having a first plunger end and a second plunger end, and a plunger joint adjacent said second plunger end;

a biasing means, said biasing means for biasing the first plunger end away from said frame;

a biasing means retainer means adjacent said first plunger end, said biasing means retainer means for retaining said biasing means to said plunger;

a link, said link having a first link end, a second link end, and a link joint, said link joint being located adjacent said second link end;

a follower, said follower having a first follower end, a second follower end, and a follower axis extending through said first follower end and said second follower end;

an adapter plate, said adapter plate having a first adapter end and a second adapter end, an appliance engagement means for engaging the adapter plate to an appliance, a hinge joint and a follower joint, said hinge joint being located adjacent said first adapter end and said appliance engagement being located adjacent said second adapter end, said follower joint being located at a distance from said first end; and a cam means, said cam means for controlling the translation of the follower relative to the link and the adapter plate, wherein said control of such translation biases rotation of said adapter plate in a non-linear relation with the force exerted by the biasing means;

wherein said link is rotatably connected to said plunger adjacent the first link end by said plunger joint;

wherein said follower is connected to said link adjacent the first follower end by said link joint;

wherein said plunger joint comprises a pin extending through said slot, said pin constraining motion of the plunger joint in a direction substantially parallel to said frame axis;

wherein said follower is connected to said adapter plate via said follower joint; and wherein said adapter is rotatably connected to said frame via said hinge joint.

15. An appliance hinge according to claim 14, wherein said cam means comprises a follower surface and a roller, and wherein said follower surface is profiled such that force applied to said adapter plate at said follower joint substantially offsets the weight of an appliance door mounted to the appliance hinge as the appliance door travels from an open position to a closed position or from a closed position to an open position.

16. An appliance hinge according to claim 15, wherein said follower surface further comprises a contour to increase the force applied to said adapter plate at said follower joint at a predetermined position.

17. An appliance hinge according to claim 15, wherein said follower surface further comprises a plurality of contours to increase the force applied to said adapter plate of said follower joint at a plurality of predetermined positions.

18. An appliance hinge according to claim 14, wherein said appliance hinge further comprises a follower locking means, said follower locking means for preventing rotation of said follower relative to said adapter plate past a predetermined position.

19. An appliance hinge according to claim 14, wherein said biasing means retaining means comprises a pin extending through said plunger, said biasing means bearing against said pin.

20. An appliance hinge, said appliance hinge comprising:

a frame, said frame having a first frame end and a second frame end and a frame axis extending through said first frame end and said second frame end, a hinge bore adjacent said first frame end, a slot adjacent said second frame end, said slot having a long axis, said long axis being substantially parallel to said frame axis;

a plunger, said plunger having a first plunger end and a second plunger end, a biasing element retainer adjacent said first plunger end and a plunger joint adjacent said second plunger end;

a biasing element, said biasing element biasing the first plunger end away from the frame;

a link, said link having a first link end, a second link end, and a link joint, said link joint being located adjacent said second link end;

a follower, said follower having a first follower end, a second follower end, and a follower surface, said follower surface having a profile;

a roller, said roller being mounted to said frame; and an adapter plate, said adapter plate having a first adapter end and a second adapter end and an adapter axis extending through the first adapter end and the second adapter end, an appliance engagement, a hinge joint and a follower joint, said hinge joint being located adjacent said first adapter end and said appliance engagement being located adjacent said second adapter end, said follower joint being located at a distance from said first end, said appliance engagement comprising a pair of engagement channels extending along an axis substantially perpendicular to the adapter axis and being sized to fit over a plurality of mounting pins, said adapter plate further comprising a locking bar for preventing motion of the adapter plate relative to the mounting pins, such that said mounting pins are retained in said engagement channels;

wherein said link is rotatably connected to said plunger adjacent the first link end by said plunger joint;

wherein said follower is connected to said link adjacent the first follower end by said link joint;

wherein said plunger joint comprises a pin extending through said slot, said pin able to slide along the slot and constraining motion of the plunger joint in a direction substantially parallel to said frame axis;

wherein said follower is connected to said adapter plate via said follower joint;

wherein said adapter is rotatably connected to said frame via said hinge joint;

wherein said locking bar further comprises a receiver and said follower comprises a shoulder, wherein said locking bar is rotatable into a position such that said shoulder engages said receiver to limit motion of said follower with respect to said adapter plate;

wherein said follower surface bears against said roller; and wherein when said adapter plate is rotated, the position of said follower is constrained by contact between said follower surface and said roller such that the force exerted by said biasing element provides a varying resistance to rotation of said adapter plate relative to said frame, said varying resistance substantially offsetting torque created by the weight of an appliance door as the appliance door is rotated from an open position to a closed position or from a closed position to an open position.

* * * * *